US011516576B2

(12) United States Patent
Small

(10) Patent No.: US 11,516,576 B2
(45) Date of Patent: Nov. 29, 2022

(54) HEADPHONE EAR PIECE COVER AND METHOD OF USE

(71) Applicant: Lamar Small, Cedar Hill, TX (US)

(72) Inventor: Lamar Small, Cedar Hill, TX (US)

( * ) Notice: Subject to any disclaimer, the term of this patent is extended or adjusted under 35 U.S.C. 154(b) by 0 days.

(21) Appl. No.: 16/146,344

(22) Filed: Sep. 28, 2018

(65) Prior Publication Data

US 2022/0141572 A1 May 5, 2022

(51) Int. Cl.
*H04R 25/00* (2006.01)
*H04R 1/10* (2006.01)

(52) U.S. Cl.
CPC ..... *H04R 1/1091* (2013.01)

(58) Field of Classification Search
CPC .. H04R 1/1091; H04R 1/1058; H04R 1/1008; H04R 1/1083; H04R 3/005; H04R 2460/01; H04R 2410/05
See application file for complete search history.

(56) References Cited

U.S. PATENT DOCUMENTS 10,448,145 B1 * 10/2019 Lewis ..... H04R 1/12
2004/0005071 A1 * 1/2004 Siskin ..... A61F 11/14 381/374

* cited by examiner

*Primary Examiner* — Amir H Etesam
(74) *Attorney, Agent, or Firm* — Leavitt Eldredge Law Firm

(57) ABSTRACT

A headphone earpiece cover includes an ear touching piece composed of a material; a headphone facing piece composed of the material and integrally connected to the ear touching piece; an elastic band integral with the headphone facing piece and surrounding an inner cavity; and the material being a moisture wicking material; the inner cavity is to receive an earpiece of a headphone; the elastic band secures the cover to the earpiece; and the ear touching piece and headphone facing piece surround the earpiece and prevent direct contact with the earpiece.

4 Claims, 6 Drawing Sheets

HEADPHONE EAR PIECE COVER AND METHOD OF USE

BACKGROUND

1. Field of the Invention

The present invention relates generally to headphones, and more specifically, to a headphone ear piece cover for protecting the original manufacture components of the headphone.

2. Description of Related Art

Headphone covers are well known in the art and are effective means to provided additional cushion to the user's ear and salvage a headphone ear piece that has started to degrade from use. For example, FIGS. 1A, 1B, and 1C depicts a conventional headphone ear piece cover 101, which is two thin pieces, a bottom piece 107 facing the user's ear and top piece 105 facing the headphone ear piece fused together of a foam material that can be stretched over the original headphone ear piece. FIG. 1A depicts the top piece 105 that has the opening which the user stretches to put over the original headphone earpiece. FIG. 1B shows the bottom piece 107 that touches the user's ear. Finally, FIG. 1C shows a side view of the headphone ear piece cover 101 with the fuse line 103 of where the top piece 105 and bottom piece 107 have been fused together.

One of the problems commonly associated with headphone ear piece cover 101 is the material collects moisture when the user perspires. The foam material of the headphone ear piece can cause damage to the internal electronics from the user's perspiration (sweat). The sweat is drawn in to the foam material and then upon reaching saturation point the foam material releases the sweat into the headphone internal electronics causing moisture damage.

Another problem associated with headphone ear piece cover 101 is also related to the propensity of the material collection of moisture from the user and because headphone ear piece cover 101 are not sturdy enough to be conveniently washed. For example, the same sweat that can damage the electric of the headphone can also allow organic microscopic material to flourish and bloom in the headphone ear piece cover 101. The microscopic material can include skin cells, dust, dirt, fungi, bacteria and other items which can then form an eco-system. This eco-system which is feed by the user's sweat and external factors can comprise of mold, mildew, bacteria, and fungi. Once an eco-system has been established in the headphone ear piece cover 101 the eco-system can now spread to the original headphone earpiece and to the user. If one of the microorganisms is pathogenic the user could become ill.

The headphone ear piece cover 101 does not lend itself to washing due to the material it is made from. Even the headphone ear piece cover 101 is washed if the eco-system has established a colony in the headphone it can become reestablished in the headphone ear piece cover 101.

Accordingly, although great strides have been made in the area of headphone ear piece covers, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
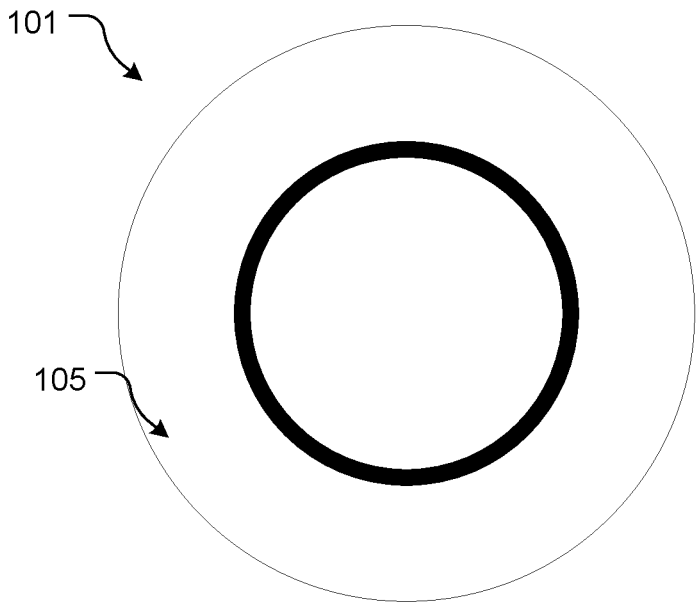
FIG. 1A (Prior Art)
FIGS. 1A and 1B are front and back views of a common headphone ear piece cover.
Figure 1B:
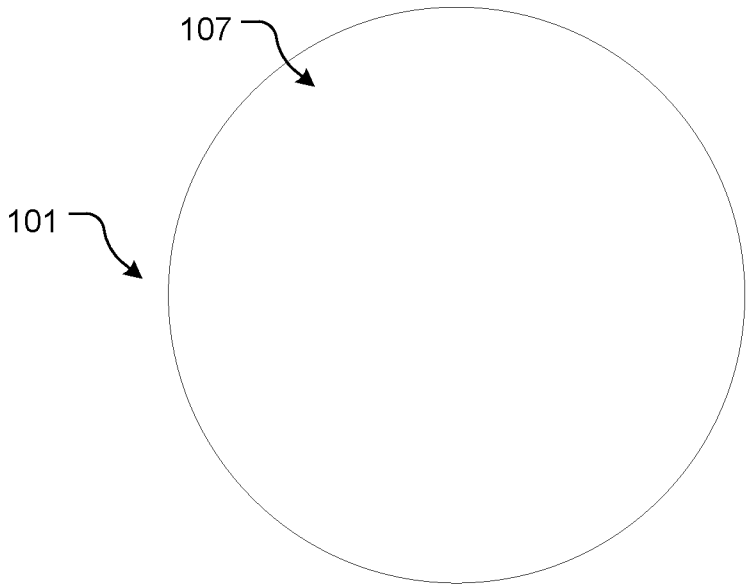
FIG. 1B (Prior Art)
Figure 1C:
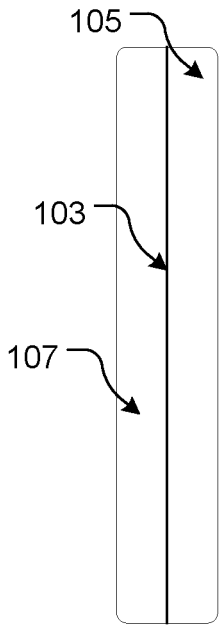
FIG. 1C (Prior Art)
FIG. 1C is a side view of a common headphone ear piece cover.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional headphone ear piece covers. Specifically, the headphone ear piece covers are made from a moisture wicking and anti-microbial stretch material that protects the internal electronics of the headphone from moisture. In addition, the anti-microbial properties coupled with the wicking properties of the material prevent moisture and sweat from building around the ear pad during use and will prevent degradation of the original headphone ear piece through moisture damage or damage caused by the establishment of a microbial eco-system colonizing the headphone ear piece. It should be appreciated that the present embodiment of headphone ear piece covers is machine washable which makes them reusable. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2A:
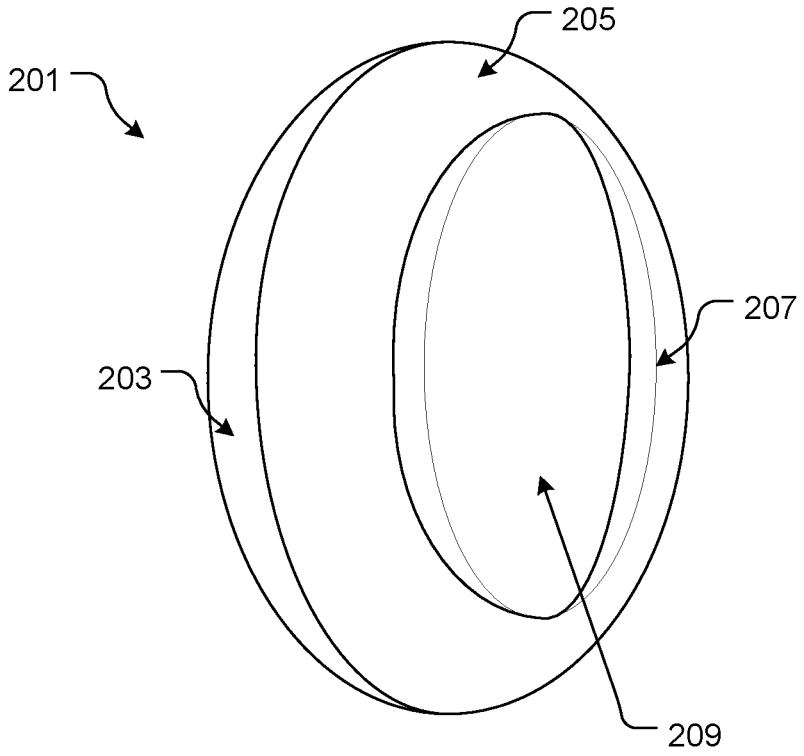
FIGS. 2A and 2B are perspective views of a headphone ear piece cover in accordance with a preferred embodiment of the present application.
Figure 2B:
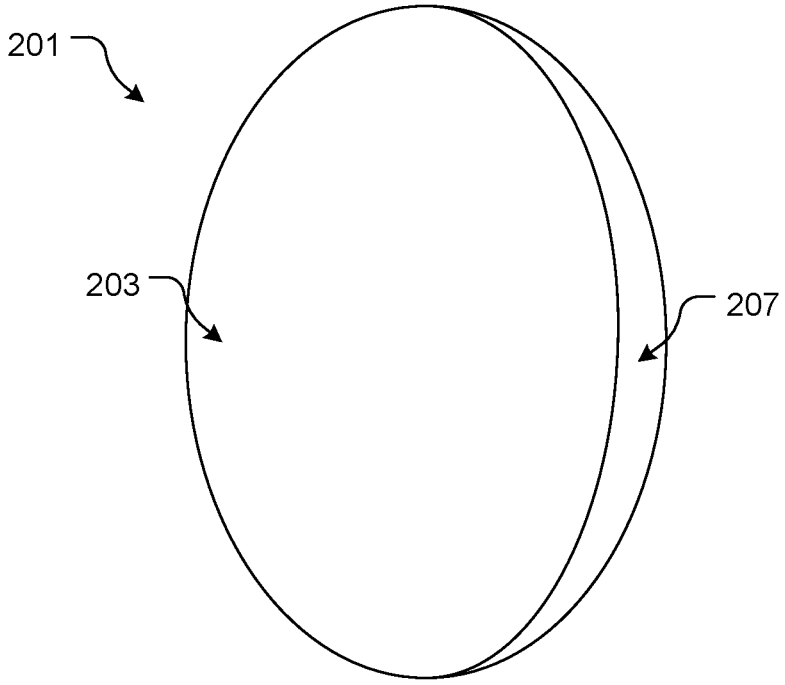

Referring now to the drawings wherein like reference characters identify corresponding or similar elements throughout the several views, FIGS. 2A and 2B depict perspective views of a headphone ear piece cover 201 in accordance with a preferred embodiment of the present application. It will be appreciated that the headphone ear piece cover 201 overcomes one of more of the above-listed problems commonly associated with conventional headphone ear piece covers.

In the contemplated embodiment, the headphone ear piece cover 201 includes an ear touching piece 203, a headphone facing piece 205, an elastic band 207, and an inner cavity 209 where the headphone ear piece fits into. It should be appreciated that the elastic band 207 securely holds the headphone ear piece cover 201 over the headphone ear piece.

Figure 3A:
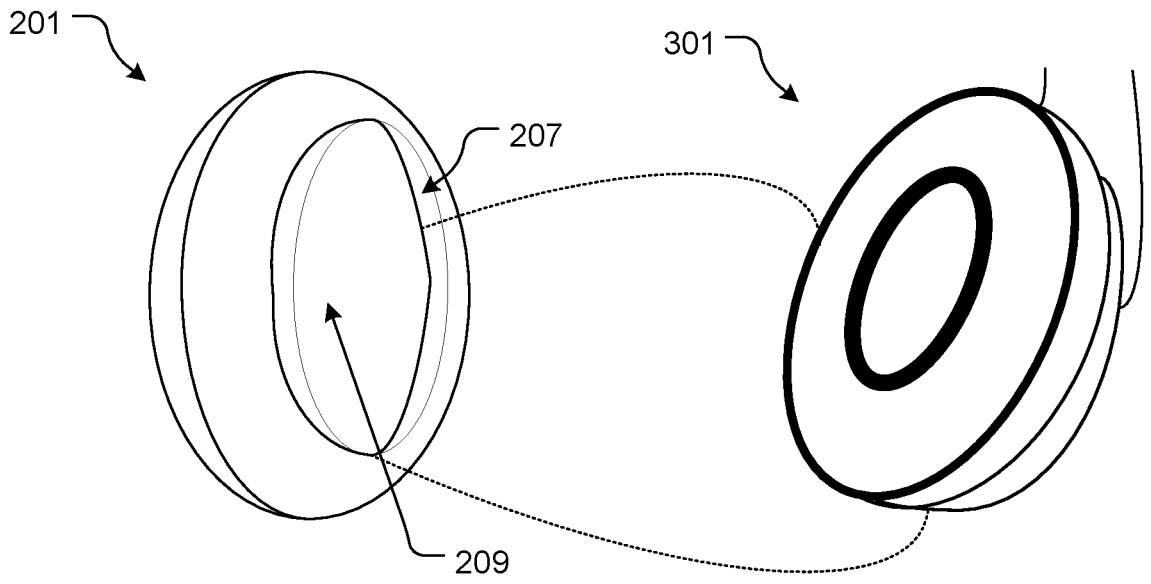
FIGS. 3A and 3B are perspective views of a headphone ear piece cover in accordance with a preferred embodiment of the present application.
Figure 3B:
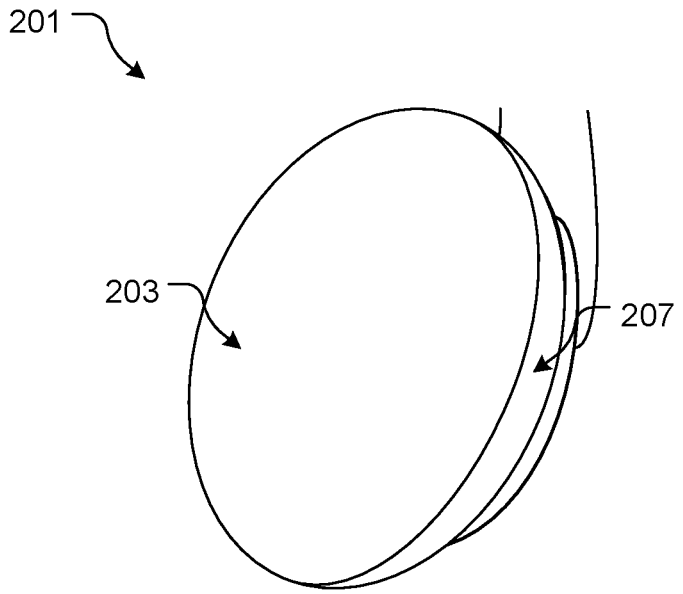

Now referring to FIGS. 3A and 3B which depicts the placement of the headphone ear piece cover 201 onto a headphone ear piece 301. The elastic band 207 stretches over the headphone ear piece 301 and securely holds the headphone ear piece cover 201 in place.

Figure 4A:
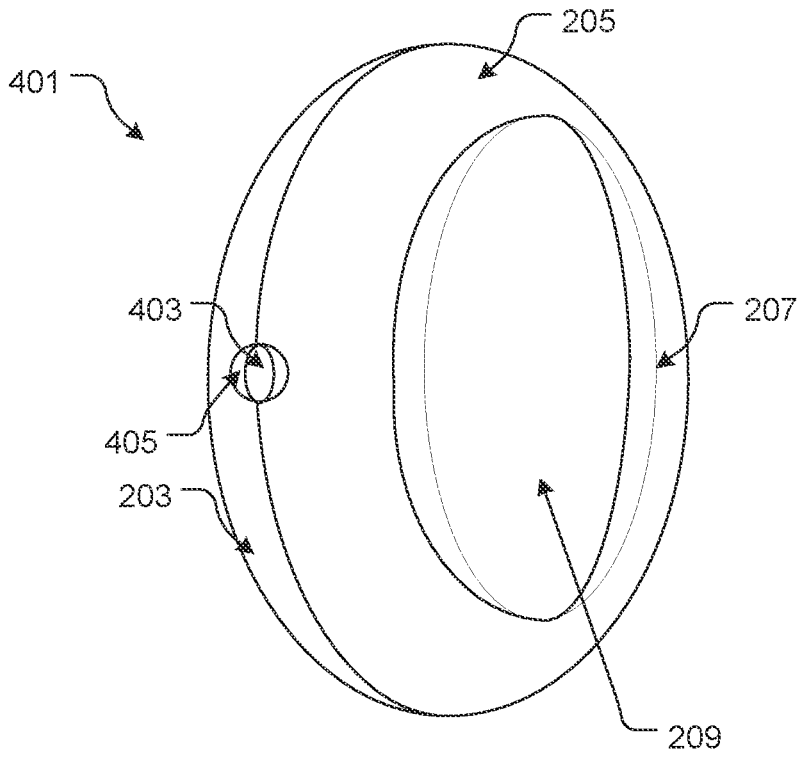
FIGS. 4A and 4B are perspective views of an alternative embodiment of a headphone ear piece cover in accordance with the present application.
Figure 4B:
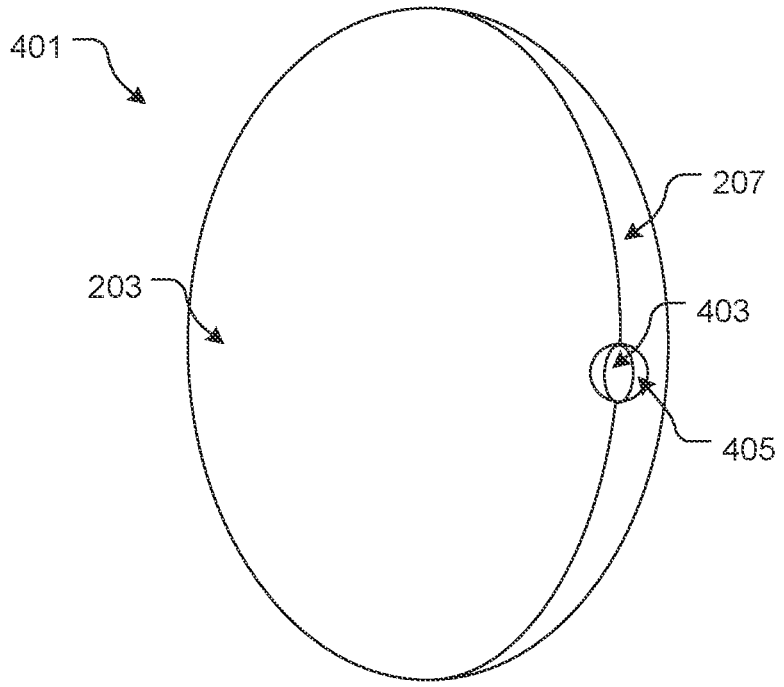

Now referring to FIGS. 4A and 4B which depicts perspective views of an alternative embodiment of a headphone ear piece cover 401. In this embodiment 401, there is an access port 403 allowing the user to run a cable through to connect to an audio system that is not wireless. The access port 403 can also have an elastic band 405 to secure the cable and prevent entry of moisture into the internal electronics of the headphone.

It should be appreciated that one of the unique features believed characteristic of the present application is the ability of the moisture wicking and antimicrobial properties of the material solves several defects found with common headphone ear covers. These properties will prevent degradation of the material of the headphone ear piece, prevent damage to the internal electronics, and improve user health by removing a possible reservoir of pathogenic microorganisms. In one embodiment, the material is approximately 88% polyester and 12% spandex with a moisture wicking and antimicrobial coating. It should further be appreciated that the ear touching piece and headphone facing piece substantially cover the earpiece to prevent any of the earpiece from coming into contact with the wearer.

Figure 5:
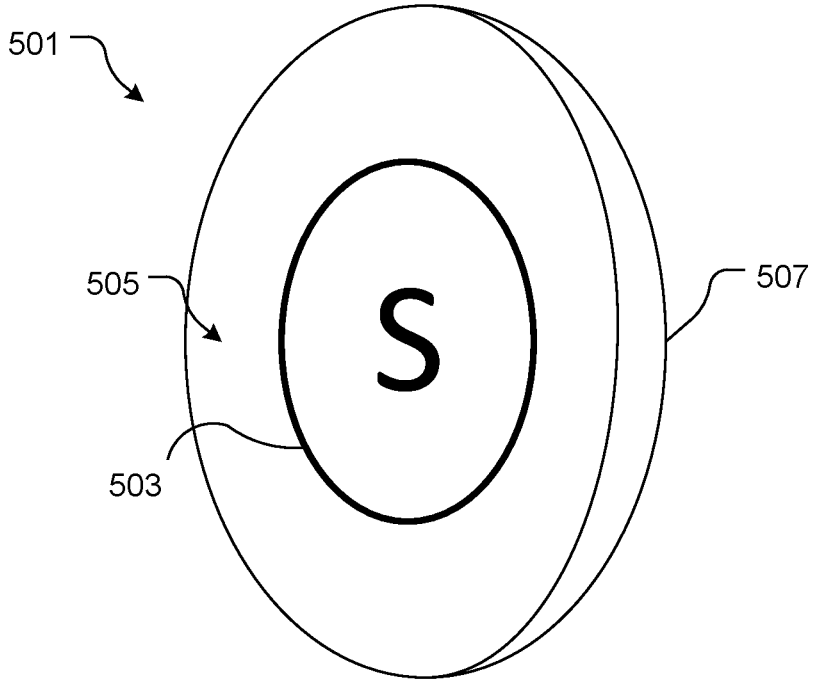
FIG. 5 is a perspective view of an alternative embodiment a headphone ear piece cover in accordance with the present application.

In FIG. 5, a front view of an alternative embodiment of a headphone ear piece cover 501 is shown, being similar in form and function to either cover 201 or 401. In this embodiment, an emblem 503 is printed on the ear touching piece 505. It should be appreciated that this feature allows for use of the headphone ear piece cover 501, when secured over an earpiece via elastic band 507, as a means of advertisement. This feature is possible due to the fact that the ear touching piece 505 is a single piece of material. It should be appreciated that the emblem 503 can be a picture, a company logo, one or more colors, or any other emblem, thereby allowing for companies or individuals to advertise and/or customize through the cover.

Figure 6:
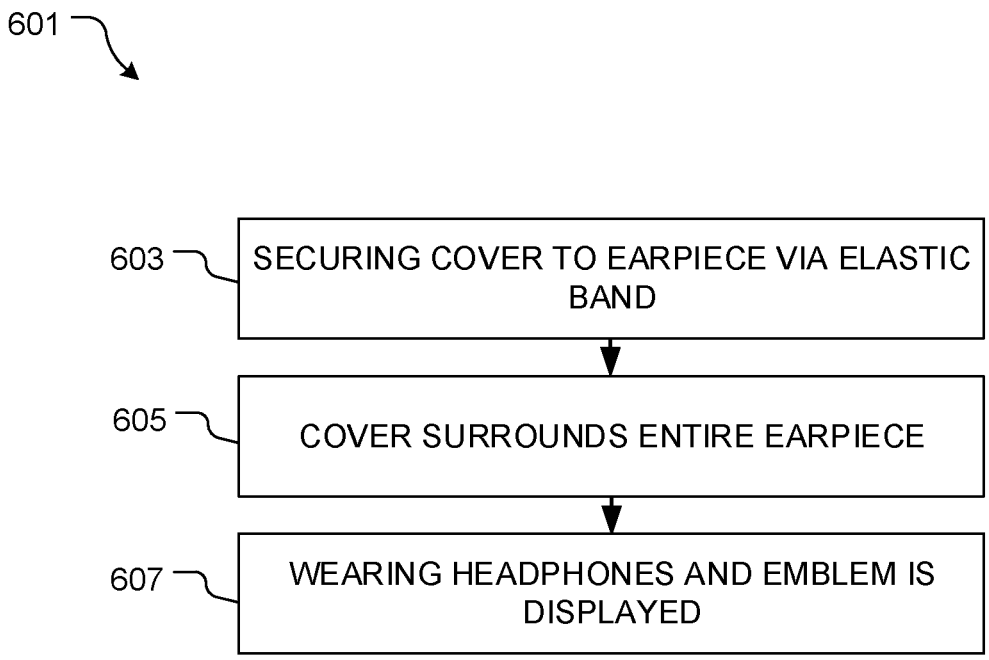
FIG. 6 is a flowchart of a method of use of the headphone ear piece cover of FIG. 5.

In FIG. 6, a flowchart 601 depicts a method of use of headphone ear piece cover 501. During use, the user secures the headphone ear piece cover to the ear piece via the elastic band, wherein the headphone ear piece cover covers the entire ear piece, as shown with boxes 603, 605. The user proceeds to wear the headphones, wherein the emblem is displayed as a means of advertising, as shown with box 607.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A headphone earpiece cover, comprising:
an ear touching piece composed of a material;
a headphone facing piece composed of the material and integrally connected to the ear touching piece;
an elastic band integral with the headphone facing piece and surrounding an inner cavity;
an access port extending through a thickness of the ear touching piece; and
an elastic band surrounding the access port;
the material being a moisture wicking material;
wherein the inner cavity is configured to receive an earpiece of a headphone;
wherein the elastic band secures the cover to the earpiece; and
wherein the ear touching piece and headphone facing piece surround the earpiece and prevent direct contact with the earpiece.

2. The cover of claim 1, further comprising:
an emblem printed on the ear touching piece.

3. The cover of claim 1, wherein the material comprises:
a) approximately 88% polyester; and
b) approximately 12% spandex.

4. A method of using the headphone earpiece cover of claim 2, comprising:
securing the headphone earpiece cover over the earpiece via the inner cavity and the elastic band;
carrying the headphone with the headphone earpiece cover displayed;
wearing the headphone; and
removing the headphone from being worn;
wherein the emblem is an advertisement.

* * * * *